US005332713A

United States Patent [19]

Oldfield et al.

[11] Patent Number: 5,332,713

[45] Date of Patent: Jul. 26, 1994

[54] THERMAL DYE TRANSFER DYE-DONOR ELEMENT CONTAINING TRANSFERABLE PROTECTION OVERCOAT

[75] Inventors: Mary Catherine S. Oldfield, Rochester; Kin K. Lum, Webster, both of N.Y.

[73] Assignee: Eastman Kodak Company, Rochester, N.Y.

[21] Appl. No.: 163,250

[22] Filed: Dec. 7, 1993

[51] Int. Cl.[5] ..... B41M 5/035; B41M 5/38

[52] U.S. Cl. ..... 503/227; 428/195; 428/500; 428/913; 428/914

[58] Field of Search ..... 8/471; 428/195, 500, 428/913, 914

[56] References Cited

U.S. PATENT DOCUMENTS 4,666,320 5/1987 Kobayashi et al. ..... 400/241.1
4,738,555 4/1988 Nagashima ..... 400/240

FOREIGN PATENT DOCUMENTS 4-52223 9/1983 Japan ..... 503/227
5-64975 3/1993 Japan .

*Primary Examiner*—B. Hamilton Hess
*Attorney, Agent, or Firm*—Harold E. Cole

[57] ABSTRACT

A dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises poly(vinyl formal), poly(vinyl benzal) or poly(vinyl acetal) containing at least about 5 mole % hydroxyl.

20 Claims, No Drawings

THERMAL DYE TRANSFER DYE-DONOR ELEMENT CONTAINING TRANSFERABLE PROTECTION OVERCOAT

This invention relates to a dye-donor element for thermal dye transfer, and more particularly to the use of a transferable protection overcoat in the element for transfer to a thermal print.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. This is due to dye being at the surface of the dye-receiving layer of the print. These dyes can be driven further into the dye-receiving layer by thermally fusing the print with either hot rollers or a thermal head. This will help to reduce dye retransfer and fingerprint susceptibility, but does not eliminate these problems. However, the application of a protective overcoat will practically eliminate these problems.

U.S. Pat. No. 4,738,555 discloses a dye-donor element for thermal dye transfer wherein a transparent ink region is also present on the element which is used to form a protective layer over the printed image. The materials disclosed in this patent for the protective layer are "wax, vinyl chloride, vinyl acetate, acrylic resin, styrene or epoxy." U.S. Pat. No. 4,666,320 also discloses materials to be applied as a protective layer on a thermal dye transfer image. The materials disclosed in this patent are "polyester resin, epoxy resin, cellulose acetate resin, nylon resin, polyvinylpyrrolidone resin". JP 4-52223 also discloses the use of a saturated linear polyester resin for a protective layer on top of a thermal dye transfer print. As will be disclosed by comparative tests hereafter, there is a problem with many of the prior art materials disclosed above in that they exhibit undesirable dye retransfer to adjacent surfaces.

JP 5-64975 discloses protecting thermal dye transfer images by coating them with an aqueous liquid containing dispersed or dissolved polymers such as poly(vinyl acetal). There is a problem with that technique in that the material is coated onto the image after printing by using a brush, for example. It would be desirable to use the thermal print head to apply a protective coating to a thermal dye transfer print to avoid a separate, postprinting coating step which would be required for each printed image.

It is an object of this invention to provide a protective coat for a thermal dye transfer image which can be applied by the thermal print head and which avoids undesirable retransfer of dye to adjacent surfaces.

These and other objects are achieved in accordance with this invention which relates to a dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises poly(vinyl formal), poly(vinyl benzal) or poly(vinyl acetal) containing at least about 5 mole % hydroxyl.

In a preferred embodiment of the invention, the dye-donor element is a multicolor element comprising repeating color patches of yellow, magenta and cyan image dyes, respectively, dispersed in a binder, and a patch containing the protection layer.

In another embodiment of the invention, the protection layer is the only layer on the donor element and is used in conjunction with another dye-donor element which contains the image dyes.

In another preferred embodiment of the invention, the dye-donor element is a monochrome element and comprises repeating units of two areas, the first area comprising a layer of one image dye dispersed in a binder, and the second area comprising the protection layer.

In another preferred embodiment of the invention, the dye-donor element is a black-and-white element and comprises repeating units of two areas, the first area comprising a layer of a mixture of image dyes dispersed in a binder to produce a neutral color, and the second area comprising the protection layer.

In yet still another preferred embodiment of the invention, the protection layer comprises:

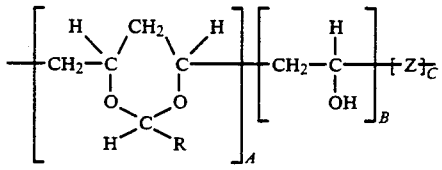

wherein:

R is H, $CH_3$ or $C_6H_5$;

A is at least about 25 mole percent;

B is from about 5 to about 75 mole percent;

Z is another monomer different from A and B such as vinyl acetate, vinyl chloride, styrene, methyl methacrylate, butyl acrylate, isopropyl acrylamide, and acrylate ionomer;

A+B is at least about 65 mole percent; and

A+B+C=100.

The present invention provides a protective overcoat layer applied to a thermal print by uniform application of heat using a thermal head. After transfer to the thermal print, the protective layer provides superior protection against image deterioration due to exposure to light, common chemicals, such as grease and oil from fingerprints, and plasticizers from film album pages or sleeves made of poly(vinyl chloride). The protection layer is generally applied in a concentration of at least about 0.05 g/m$^2$.

In use, yellow, magenta and cyan dyes are thermally transferred from a dye-donor element to form an image on the dye-receiving sheet. The thermal head is then used to transfer a clear protective layer, from another clear patch on the dye-donor element or from a separate donor element, onto the imaged receiving sheet by uniform application of heat. The clear protective layer adheres to the print and is released from the donor support in the area where heat is applied.

Materials included within the scope of the invention include the following:

1) Poly(vinyl benzal) in 2-butanone solvent.
2) Poly(vinyl acetal) KS-5z (Sekisui Co) (26 mole % hydroxyl, 74 mole % acetal) in a 3-pentanone/methanol solvent mixture (75/25).
3) Poly(vinyl acetal) KS-3 (Sekisui Co) (12 mole % hydroxyl, 4 mole % acetate, 84 mole % acetal) in a 3-pentanone/methanol solvent mixture (75/25).
4) Poly(vinyl acetal) KS-1 (Sekisui Co) (24 mole % hydroxyl, 76 mole % acetal) in a 3-pentanone/methanol solvent mixture (75/25).
5) Poly(vinyl acetal) (26 mole % hydroxyl, 74 mole % acetal) in a 3-pentanone/methanol solvent mixture (75/25).
6) Poly(vinyl acetal) (29 mole % hydroxyl, 71 mole % acetal) in a 3-pentanone/methanol solvent mixture (75/25).
7) Poly(vinyl acetal) (56 mole % hydroxyl, 44 mole % acetal) in a 3-pentanone/methanol solvent mixture (75/25).
8) Poly(vinyl acetal) (15 mole % hydroxyl, 77 mole % acetal, 8 mole % acetate) in a methanol/3-pentanone solvent mixture (75/25).
9) Poly(vinyl acetal) (20 mole % hydroxyl 51 mole % acetal, 29 mole % acetate) in a methanol/3-pentanone solvent mixture (75/25).
10) Poly(vinyl acetal) (24 mole % hydroxyl, 76 mole % acetal) in a methanol/3-pentanone solvent mixture (75/25).
11) Poly(vinyl acetal) (44 mole % hydroxyl, 43 mole % acetal, 13 mole % acetate) in a methanol/water solvent mixture (75/25).
12) Poly(vinyl acetal) (65 mole % hydroxyl, 35 mole % acetal) in a methanol/water solvent mixture (75/25).
13) Poly(vinyl acetal) (18 mole % hydroxyl, 64 mole % acetal, 18 mole % acetate) in a methanol/3-pentanone solvent mixture (75/25).
14) Poly(vinyl acetal) (16 mole % hydroxyl, 84 mole % acetal) in a methanol/3-pentanone solvent mixture (75/25).
15) Poly(vinyl formal) (Formvar ®, Monsanto Co.) (5% hydroxyl, 82% formal, 13% acetate) in a toluene/3A alcohol/water mixture (57/40/3).

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS ® (Sumitomo Chemical Co., Ltd.), Dianix Fast Violet 3R FS ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumikaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumiacryl Blue 6G ® (Sumitomo Chemical Co., Ltd.), and Aizen Malachite Green ® (Hodogaya Chemical Co., Ltd.);

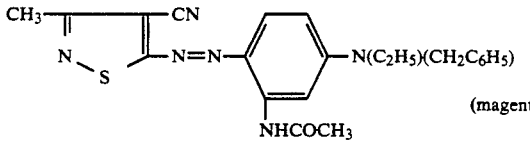
(magenta)

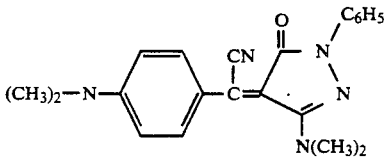
(magenta)

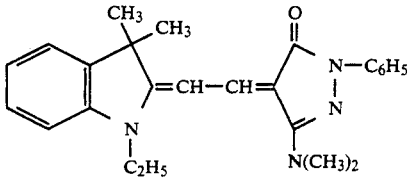
(yellow)

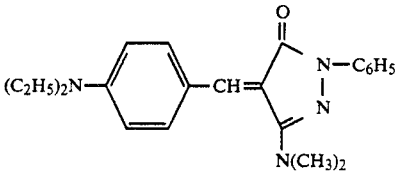
(yellow)

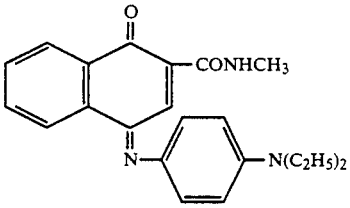
(cyan)

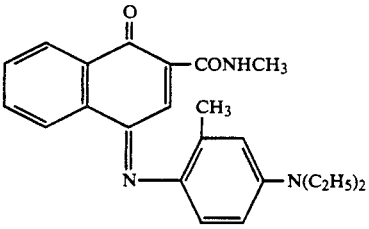
(cyan)

or any of the dyes disclosed in U.S. Pat No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

The following examples are provided to illustrate the invention.

EXAMPLE 1

Control protective layer donor elements were prepared by coating on a 6 μm poly(ethylene terephthalate) support:

1) a subbing layer of titanium alkoxide (DuPont Tyzor TBT) ® (0.12 g/m$^2$) from a n-propyl acetate and n-butyl alcohol solvent mixture, and
2) a slipping layer containing an aminopropyldimethyl-terminated polydimethylsiloxane, PS513 ® (Petrarch Systems, Inc.)(0.01 g/m$^2$), a cellulose acetate propionate binder (0.54 g/m$^2$), p-toluenesulfonic acid (0.0003 g/m$^2$), candellila wax (0.02 g/m$^2$), a copolymer of poly(propylene oxide) and poly(methyl octyl siloxane), BYK320-S732® (98% in Stoddard solvent) (Byk Chemie), (0.005 g/m$^2$), coated from a solvent mixture of toluene, methanol and cyclopentanone (66.5/28.5/5).

The other side of the donor element was coated with a solution of the polymer as listed in Table 1 in a solvent as noted. An automated sample coater was used to deliver the solution through a hopper at 16.1 ml/m$^2$ [21.5 for poly(vinyl alcohol)] at a coating speed of 4.26 cm/sec. The coatings were dried on a coating block maintained at 29° C. except for aqueous solutions, in which case the temperature was raised to 49° C. for drying of the coatings. The laydown was 0.32 g/m$^2$.

Dye-donor elements were prepared by coating on a 6 μm poly(ethylene terephthalate) support:

1) a subbing layer of titanium alkoxide (DuPont Tyzor TBT)® (0.13 g/m$^2$) from a n-propyl acetate and n-butyl alcohol solvent mixture, and
2) repeating yellow, magenta and cyan dye patches containing the compositions as noted below.

On the back side of the element were coated the following layers in sequence:

1) a subbing layer of titanium alkoxide (DuPont Tyzor TBT)® (0.13 g/m$^2$) from n-butyl alcohol solvent, and
2) a slipping layer containing an aminopropyldimethyl-terminated polydimethylsiloxane, PS513® (Petrarch Systems, Inc.)(0.01 g/m$^2$), a poly(vinyl acetal) binder (0.54 g/m$^2$), p-toluenesulfonic acid (0.0003 g/m$^2$), candellila wax (0.02 g/m$^2$), coated from a solvent mixture of toluene, methanol and cyclopentanone (66.5/28.5/5).

The yellow composition contained 0.26 g/m$^2$ of the first yellow dye illustrated above, 0.32 g/m$^2$ of cellulose acetate propionate, 0.002 g/m$^2$ of FC-430® fluorocarbon surfactant (3M Corp.) in a solvent mixture of toluene, methanol and cyclopentanone (66.5/28.5/5).

The magenta composition contained 0.14 g/m$^2$ of the first magenta dye illustrated above, 0.15 g/m$^2$ of the second magenta dye illustrated above, 0.34 g/m$^2$ of cellulose acetate propionate, 0.002 g/m$^2$ of FC-430® fluorocarbon surfactant (3M Corp.) in a solvent mixture of toluene, methanol and cyclopentanone (66.5/28.5/5).

The cyan composition contained 0.38 g/m$^2$ of the first cyan dye illustrated above, 0.11 g/m$^2$ of the second cyan dye illustrated above, 0.34 g/m$^2$ of cellulose acetate propionate, 0.02 g/m$^2$ of a micronized blend of polyethylene, polypropylene and oxidized polyethylene particles (S363 N-1) (Shamrock Technologies, Inc.), 0.002 g/m$^2$ of FC-430® fluorocarbon surfactant (3M Corp.) in a solvent mixture of toluene, methanol and cyclopentanone (66.5/28.5/5).

The dye-receiving element was prepared by coating a subbing layer of 0.11 g/m$^2$ Dow Z-6020 in 99% ethanol/1% water onto a microvoided polypropylene support with a poly(vinyl alcohol)/poly(ethylene oxide) antistatic backing layer. The following receiving and overcoat layers were then simultaneously coated over the subbing layer.

Receiving Layer 1.78 g/m$^2$ of KL3-1013 polyether-modified bisphenol A polycarbonate identified below
1.46 g/m$^2$ Lexan® 141-112 bisphenol A polycarbonate (General Electrical Co.)
0.32 g/m$^2$ diphenyl phthalate
0.32 g/m$^2$ dibutyl phthalate
0.01 g/m$^2$ FC-431® fluorocarbon surfactant (3M Corp.)
Solvent: Methylene chloride Receiver Overcoat 0.22 g/m$^2$ bisphenol A polycarbonate containing 49% diethylene glycol and 1% polydimethyl-siloxane
0.008 g/m$^2$ DC-510 silicone surfactant (Dow-Corning)
0.02 g/m$^2$ FC-431® fluorocarbon surfactant (3M Corp.)
Solvent: Methylene chloride Polycarbonates used

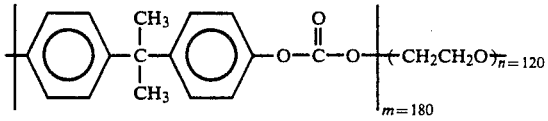

KL3-1013, block copolymer of polyether glycol and bisphenol A polycarbonate (Bayer AG)

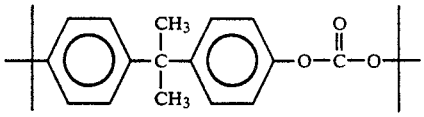

Bisphenol A polycarbonate Lexan 141® (General Electric Company)

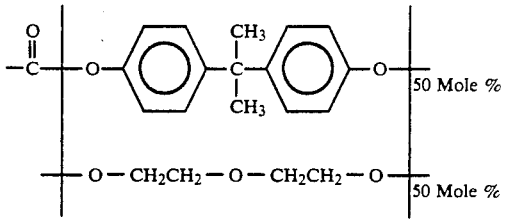

Polycarbonate 3: 4,4'-Isopropylidene-bisphenol-co-2,2'-oxydiethanol polycarbonate (50:50 random copolymer)

The dye side of the dye-donor elements described above, in a strip about 10×14 cm in area, was placed in contact with the dye image-receiving layer of a dye-receiver element, as described above, of the same area. The assemblage was clamped to a stepper-motor driving a 53 mm diameter rubber roller, and a TDK Thermal Head (No. L-231) (thermostatted at 30° C.) was pressed with a force of 24.5 Newtons against the dye-donor element side of the assemblage pushing it against the rubber roller. (The TDK L-231 thermal print head has 512 independently addressable heaters with a resolution of 5.4 dots/nun and an active printing width of 95 mm, of average heater resistance 512 ohms.)

The imaging electronics were activated and the assemblage was drawn between the printing head and roller at 20.6 mm/sec. Coincidentally, the resistive elements in the thermal print head were pulsed on for 128 μsec every 130 μsec. Printing maximum density requires 63 pulses "on" time per printed line of 9.0 msec.

The voltage supplied was 12.65 volts resulting in an instantaneous peak power of approximately 0.313 Watts/dot and the maximum total energy required to print 2.3 Dmax was 2.52 mjoules/dot. The image was printed with a 1:1 aspect ratio. This printing scheme was repeated in succession for each of the three-color dye-donor elements.

Once the image was formed, the laminate donor was placed in contact with the print and heated uniformly at an energy level equivalent to a printing maximum dye density (2.52 mJ/dot) with the thermal head to permanently adhere the polymeric film to the print. At the end of the heating cycle the donor support was peeled away leaving the polymeric film adhered to the print.

The retransfer image consisted of Dmax blocks each of yellow, magenta, and cyan as well as single small blocks of Dmax red, green, blue, neutral, neutral mid-scale and text in all colors. Two areas in each of the yellow, magenta, and cyan and one in the neutral areas were marked.

The laminate samples were then evaluated for resistance to retransfer to a poly(vinyl chloride)-coated substrate. Poly(vinyl chloride) sheets (PVC sheets) containing 31.9 g/m$^2$ 2-ethylhexyl phthalate were placed in contact with the printed image. The images and PVC sheets were placed in a stack. A 1 kg weight was placed on top of the approximately 10 by 14 cm prints. The stacked prints plus weight were placed in a 50° C./60%RH oven for 7 days. An average of the Status A Transmission densities of the now dye-stained PVC sheets were read for dye uptake in the marked areas.

The results are listed in Tables 1 through 5.

TABLE 1

| Element | Protective Layer | Solvent | Magenta Status A Transmission Density |
|---|---|---|---|
| Control 1 | Vylon ® 600 polyester (Toyobo KK) | 2-butanone | 0.80* |
| Control 2 | Vylon ® 300 polyester (Toyobo KK) | 2-butanone | ** |
| Control 3 | Vylon ® 103 polyester (Toyobo KK) | 2-butanone | ** |
| Control 4 | Polycarbonate 3 | 70/30 methylene chloride/-trichloroethane | 0.51 |
| Control 5 | Poly(methyl methacrylate | 95/5 acetone/ cyclopentanone | 0.03* |
| Control 6 | Cellulose Acetate Propionate (20% Acetyl, 46% Propionyl) | 95/5 acetone/ cyclopentanone | 0.83 |
| Control 7 | Cellulose Acetate Propionate (2.5% Acetyl, 45% Propionyl) | 95/5 acetone/cyclo-pentanone | *** |
| 4 | Poly(vinyl acetal) | 75/25 3-pentanone/ methanol | 0.03 |

The above results show that the poly(vinyl acetal) of the invention had much less magenta dye uptake than the other control materials.

EXAMPLE 2

Example 1 was repeated but using the materials having the structures shown below. The densities that were obtained on the PVC sheets were from the neutral dye patches. The following results were obtained:

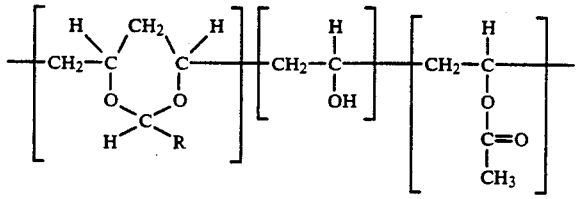

poly(vinyl acetal) poly(vinyl alcohol) poly(vinyl acetate)

TABLE 2

| Protective Layer | R | Status A Transmission Density Yellow | Magenta | Cyan |
|---|---|---|---|---|
| Control 8 poly(vinyl alcohol) (88% hydroxyl) | — | * | * | * |
| Control 9 poly(vinyl acetate) | — | 0.70 | 0.65 | 0.71 |
| Control 10 poly(vinyl propional) (63% propionyl, 37% hydroxyl) | $C_3H_7$ | 0.63 | 0.58 | 0.65 |
| Control 11 poly(vinyl butyral) Butvar 98 ® | $C_4H_9$ | 0.70 | 0.68 | 0.72 |
| Control 12 poly(vinyl butyral) Butvar 76 ® | $C_4H_9$ | 0.69 | 0.64 | 0.68 |
| 1 poly(vinyl benzal) | $C_6H_5$ | 0.26 | 0.27 | 0.35 |
| 4 poly(vinyl acetal) | $CH_3$ | 0.02 | 0.03 | 0.03 |
| 15 poly(vinyl formal) | H | 0.15 | 0.15 | 0.18 |

*Did not adhere well to receiver

The above data show that compounds according to the invention perform significantly better than closely-related compounds as a comparison.

EXAMPLE 3

Example 1 was repeated using the compounds in Table 3 below. The following results were obtained:

TABLE 3

| Protective Layer | mole % Acetal | mole % Hydroxyl | mole % Acetate | Magenta Status A Transmission Density |
|---|---|---|---|---|
| 2 | 74 | 26 | 0 | 0.02 |
| 3 | 84 | 12 | 4 | 0.03 |
| 4 | 76 | 24 | 0 | 0.03 |
| 5 | 74 | 26 | 0 | 0.03 |
| 6 | 77 | 29 | 0 | 0.03 |
| 7 | 44 | 56 | 0 | 0.03 |
| 8 | 77 | 15 | 8 | 0.03 |
| 9 | 51 | 20 | 29 | 0.05 |
| 10 | 76 | 24 | 0 | 0.03 |
| 11 | 43 | 44 | 13 | 0.03 |
| 13 | 64 | 18 | 18 | 0.07 |
| 14 | 84 | 16 | 0 | 0.03 |

TABLE 3-continued

| Protective Layer | mole % Acetal | mole % Hydroxyl | mole % Acetate | Magenta Status A Transmission Density |
|---|---|---|---|---|
| Control 8 | 0 | 88 | 12 | * |
| Control 9 | 0 | 0 | 100 | 1.03 |
| Control 11** | 0 | 19 | 1 | 1.00 |
| Control 12*** | 0 | 11 | 1 | 1.00 |
| Control 13**** poly(vinyl acetal-co-butyral) | 82 | 4 | 0 | 0.85 |
| Control 14 | 65 | 0 | 35 | 0.92 |

*Did not adhere to receiver layer
**This sample had additional butyral content of 80 mole %.
***This sample had additional butyral content of 88 mole %
****This sample had additional butyral content of 14 mole %.

The above data shows that composition of the (polyvinyl acetal) in accordance with the invention has an effect on retransfer resistance.

EXAMPLE 4

Example 1 was repeated but using different laydown amounts of poly(vinyl acetal) as noted in Table 5. The following results were obtained:

TABLE 5

| Protective Layer | Coverage (g/m$^2$) | Magenta Status A Transmission Density |
|---|---|---|
| 6 | 0.08 | 0.20 |
| 6 | 0.16 | 0.11 |
| 6 | 0.32 | 0.03 |
| 6 | 0.65 | 0.02 |
| 6 | 1.08 | 0.02 |

The above data show that various amounts of the protective layer provides good resistance to dye retransfer.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon at least one dye layer area comprising an image dye in a binder and another area comprising a transferable protection layer, said transferable protection layer area being approximately equal in size to said dye layer area, wherein said transferable protection layer comprises poly(vinyl formal), poly(vinyl benzal) or poly(vinyl acetal) containing at least about 5 mole % hydroxyl.

2. The element of claim 1 wherein said transferable protection layer comprises poly(vinyl acetal).

3. The element of claim 1 wherein said transferable protection layer comprises:

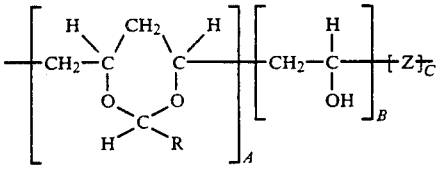

-continued wherein:

R is H, $CH_3$ or $C_6H_5$;

A is at least about 25 mole percent;

B is from about 5 to about 75 mole percent;

Z is another monomer different from A and B;

A+B is at least about 65 mole percent; and

A+B+C=100.

4. The element of claim 3 wherein A+B=100 mole percent.

5. The element of claim 3 wherein C is vinyl acetate.

6. The element of claim 1 wherein said dye-donor element is a multicolor element comprising repeating color patches of yellow, magenta and cyan image dyes, respectively, dispersed in a binder, and a patch containing said protection layer.

7. A process of forming a protection layer on top of a thermal dye transfer image comprising:

(a) imagewise-heating a dye-donor element comprising a support having thereon a dye layer comprising an image dye in a binder, said dye-donor being in contact with a dye-receiving element, thereby transferring a dye image to said dye-receiving element to form said dye transfer image; and (b) thermally transferring a protection layer on top of said transferred dye image, said protection layer being applied from an element which contains a layer comprising poly(vinyl formal), poly(vinyl benzal) or poly(vinyl acetal) containing at least about 5 mole % hydroxyl.

8. The process of claim 7 wherein said protection layer is present on a separate area of said dye-donor element.

9. The process of claim 7 wherein said protection layer is present on a separate donor element.

10. The process of claim 7 wherein said transferable protection layer comprises poly(vinyl acetal).

11. The process of claim 7 wherein said transferable protection layer comprises:

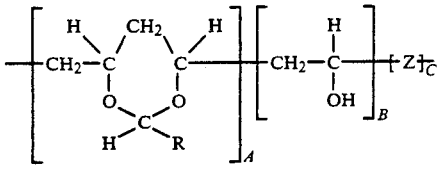

wherein:

R is H, $CH_3$ or $C_6H_5$;

A is at least about 25 mole percent;

B is from about 5 to about 75 mole percent;

Z is another monomer different from A and B;

A+B is at least about 65 mole percent; and

A+B+C=100.

12. The process of claim 11 wherein A+B=100 mole percent.

13. The process of claim 11 wherein C is vinyl acetate.

14. The process of claim 7 wherein said dye-donor element is a multicolor element comprising repeating color patches of yellow, magenta and cyan image dyes, respectively, dispersed in a binder, and a patch containing said protection layer.

15. A thermal dye transfer assemblage comprising (a) a dye-donor element for thermal dye transfer comprising a support having thereon at least one dye layer area comprising an image dye in a binder and another area comprising a transferable protection layer, said transferable protection layer area being approximately equal in size to said dye layer area, wherein said transferable protection layer comprises poly(vinyl formal), poly(vinyl benzal) or poly(vinyl acetal) containing at least about 5 mole % hydroxyl; and (b) a dye receiving element comprising a support having thereon a dye image-receiving layer, said dye-receiving element being in a superposed relationship with said dye-donor element so that said dye layer is in contact with said dye image-receiving layer.

16. The assemblage of claim 15 wherein said transferable protection layer comprises poly(vinyl acetal).

17. The assemblage of claim 15 wherein said transferable protection layer comprises:

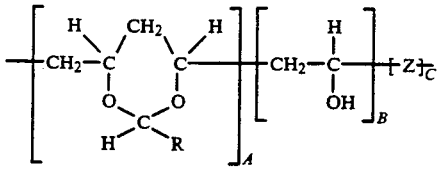

wherein:

R is H, $CH_3$ or $C_6H_5$;

A is at least about 25 mole percent;

B is from about 5 to about 75 mole percent;

Z is another monomer different from A and B;

A+B is at least about 65 mole percent; and

A+B+C=100.

18. The assemblage of claim 17 wherein A+B=100 mole percent.

19. The assemblage of claim 17 wherein C is vinyl acetate.

20. The assemblage of claim 15 wherein said dye-donor element is a multicolor element comprising repeating color patches of yellow, magenta and cyan image dyes, respectively, dispersed in a binder, and a patch containing said protection layer.

* * * * *